US005771836A

United States Patent [19]

Crouse

[11] Patent Number: 5,771,836

[45] Date of Patent: Jun. 30, 1998

[54] WATER SKIER WARNING FLAG SYSTEM

[75] Inventor: Tyler J. Crouse, Sun City, Ariz.

[73] Assignee: Dupras Grinding Company, Inc., Phoenix, Ariz.

[21] Appl. No.: 632,655

[22] Filed: Apr. 15, 1996

[51] Int. Cl.[6] ..... G09F 17/00; B63C 9/00

[52] U.S. Cl. ..... 116/209; 116/173

[58] Field of Search ..... 116/173, 175, 116/209, 303; 441/68

[56] References Cited

U.S. PATENT DOCUMENTS

| | | | |
|---|---|---|---|
| 352,618 | 11/1886 | Jones | 116/173 |
| 1,505,343 | 8/1924 | Heath | 116/303 X |
| 3,735,724 | 5/1973 | Miller | 116/173 X |
| 4,545,320 | 10/1985 | Lewis et al. | 116/28 R |
| 4,640,213 | 2/1987 | Lugo | 116/173 X |

*Primary Examiner*—Diego F.F. Gutierrez
*Assistant Examiner*—Willie Morris Worth
*Attorney, Agent, or Firm*—Martin L. Stoneman

[57] ABSTRACT

This invention concerns a water skier warning flag system of the type wherein the slackening of the tow rope causes a warning flag at the transom of the ski boat to be raised. A mechanical device mounted on the rear of the transom of a ski boat includes a lever having a normally vertical long lever arm for holding a longitudinally-mounted (normally vertical) standard of a warning flag; and this long lever arm also has a connection point to a ski tow line. The other (short) lever arm is urged by a compression spring to maintain the long lever arm vertical. When a skier is skiing, the tension on the tow line pulls the long lever arm down to horizontal against the pressure of the compression spring; and when the tow line goes slack, the spring pressure returns the long lever arm to vertical.

20 Claims, 3 Drawing Sheets

WATER SKIER WARNING FLAG SYSTEM

BACKGROUND OF THE INVENTION

1. Field of the Invention

This invention relates to providing a water skier warning flag system. More particularly, this invention concerns a water skier warning flag system of the type wherein the slackening of the tow rope causes a warning flag to be raised at the transom of the boat pulling the water skier (herein called the "ski boat").

2. Description of the Prior Art

A ski flag is the universal means to alert any individuals in the vicinity that a skier is "down" in the water. A water skier, while not up on top of the water, skiing, but rather down in the water, stationary, is difficult to see and is vulnerable to being hit by other boats operating in the area. This is due to three major factors. A water skier stationary in the water, not unlike a swimmer, is a reasonably small object to be seen, with only the skier's head, or at most, a portion of upper torso, being above the surface of the water; and if the water is rough or choppy, such skier may be intermittently hidden from view. Additionally, other boats operating in the area are generally watching for boats and their direction of travel, or for large debris such as logs etc., but may not be expecting to encounter, or even looking for, an individual in the water. And thirdly, some boaters would expect to have swimmers and other people in the water mainly confined to beaches, shore lines, banks, established swimming areas, etc., but not out in the open boating ways where higher boating speeds are encountered. To provide for water skiing safety, many states incorporate laws and regulations governing the use of ski flags and additionally, the incorporation of a "spotter", i.e., a non-driving person on the boat whose duty it is to watch the skier and raise a warning flag when the skier falls or stops skiing and to have the driver immediately stop the high-speed operation of the boat to go get the water skier safely out of the water.

In the prior art, many systems for warning devices, and even automatic flag raising, have been tried. However, these prior systems are inefficient in operation, expensive to provide and maintain in working order, and too large and difficult to install. For example, the prior art system described in U.S. Pat. No. 3,735,724, issued to Nathan W. Miller, provides a ski flag which is raised when the tow rope slackens. But the Miller device is complicated by fluid damping, use of a torsion spring on a movable shaft, placement of the flag forward of the boat operator, a line guide system to connect to the normal tow line aft of the boat's transom, etc. Various other devices are described in the art for attachment to the tow rope at the stern of the ski boat with some sort of spring action to raise the flag when the tow rope slackens, all poorly placed and all with overly complicated and untrustworthy spring and/or rope eyelet arrangements.

OBJECTS OF THE INVENTION

A primary object of the present invention is to fulfill the above-mentioned needs and overcome the above-mentioned problems by the provision of an improved water skier warning flag system for automatically raising a warning flag on a flag pole to the rear of a stern transom of a ski boat when a tow rope on a said ski boat goes slack. A further primary object of the present invention is to provide such a system which is efficient, inexpensive, and handy. Other objects of this invention will become apparent with reference to the following invention descriptions.

SUMMARY OF THE INVENTION

According to a preferred embodiment of the present invention, this invention provides a water skier warning flag system for automatically raising a warning flag on a flag pole to the rear of a stern transom of a ski boat when a tow rope on a such ski boat goes slack comprising, in combination: mechanical means for positionally controlling a such flag pole; connection means for connecting such mechanical means to a such stern transom of a such ski boat; such mechanical means comprising lever means having a short arm and a long arm and having transverse-hole means through a pivot line of such lever means, housing means comprising (1) a shaft means for rotatably holding such lever means, and (2) a compression spring means constructed and arranged to push against such short arm of such lever means, first long arm means on such long arm for connecting with a such tow rope, and second long arm means on such long arm for connecting with a such flag pole. This invention further provides such a warning flag system wherein such lever means is essentially arcuate, such short arm and such long arm being situate at an angle of substantially less than 180 degrees. And it provides such a warning flag system wherein such compression spring means is constructed and arranged to normally push such long arm into substantially vertical position. Further, the present invention provides such a warning flag system wherein such housing means further comprises stop means for stopping travel of such long arm when such push of such compression spring means pushes such long arm into such substantially vertical position.

Even further, this invention provides such a warning flag system wherein such second long arm means is constructed and arranged to hold a such flag pole longitudinally to such long arm; and, further, wherein such connection means is constructed and arranged to connect such mechanical means to a such stern transom of a such ski boat in such manner as to maintain such compression spring means in a substantially vertical position; and, further, wherein such connection means is constructed and arranged to connect such mechanical means to a such stern transom of a such ski boat in such manner as to maintain such shaft means in a substantially horizontal position and transverse to a such ski boat. This invention also provides such a warning flag system wherein such housing means is constructed and arranged in such manner as to maintain a such flag pole, when held by such second long arm means, along a line perpendicular to and intersecting with such pivot line.

Additionally, this invention provides such a warning flag system wherein such mechanical means is constructed and arranged in such manner as to compress such compression spring means when a such tow rope is connected to such first long arm means and pulling on such first long arm means. And it provides such a warning flag system wherein such mechanical means is constructed and arranged in such manner as to maintain a such flag pole, when held by such second long arm means, in a substantially horizontal position when a water skier is water skiing on a such tow rope connected to such first long arm means and pulling on such first long arm means; and, further, wherein such mechanical means is constructed and arranged in such manner as to maintain a such flag pole, when held by such second long arm means, in a substantially vertical position when a water skier releases a such tow rope connected to such first long arm means and pulling on such first long arm means. It also provides such a warning flag system wherein such shaft means is nonrotatably connected to such housing means.

Moreover, in accordance with a preferred embodiment thereof, this invention provides a water skier warning flag system for automatically raising a warning flag on a flag pole to the rear of a stern transom of a ski boat when a tow rope on a such ski boat goes slack comprising, in combination: a such ski boat having a such stern transom; a such flag pole having a such warning flag connected to a first end of such flag pole; mechanical means for positionally controlling such flag pole, such mechanical means comprising lever means having a short arm and a long arm and having transverse-hole means through a pivot line of such lever means, housing means comprising (1) a shaft means for rotatably holding such lever means, and (2) a compression spring means constructed and arranged to push against such short arm of such lever means, first long arm means on such long arm for connecting with a such tow rope, and second long arm means on such long arm for connecting with a second end of such flag pole; connection means for connecting such mechanical means to such stern transom of such ski boat; and a such tow rope connected to such first long arm means. And it further provides such a warning flag system wherein such lever means is essentially arcuate, such short arm and such long arm being situate at an angle of substantially less than 180 degrees.

Even additionally, the present invention provides such a warning flag system wherein such mechanical means is constructed and arranged in such manner as to compress such compression spring means when a such tow rope is connected to such first long arm means and pulling on such first long arm means. It also provides such a warning flag system wherein such shaft means is nonrotatably connected to such housing means. And it further provides such a warning flag system wherein such mechanical means is constructed and arranged in such manner as to maintain a such flag pole, when held by such second long arm means, in a substantially horizontal position when a water skier is water skiing on such tow rope connected to such first long arm means and pulling on such first long arm means; and, further, wherein such mechanical means is constructed and arranged in such manner as to maintain a such flag pole, when held by such second long arm means, in a substantially vertical position when a water skier releases such tow rope connected to such first long arm means and pulling on such first long arm means.

Yet even further, according to a preferred embodiment thereof, the present invention provides a water skier warning flag system for automatically raising a warning flag on a flag pole to the rear of a stern transom of a ski boat when a tow rope on a such ski boat goes slack comprising, in combination: a housing containing a vertical compression spring and means for connecting such housing to such rear of such stern transom; a lever having a short arm and a long arm and rotatably connected rearward of such compression spring to such housing along a lever pivot line; such housing being constructed and arranged in such manner that such compression spring pushes downwardly on such short arm; such long arm being constructed and arranged for connecting with a such tow rope; and such long arm being constructed and arranged for holding such flag pole vertically upward when such compression spring is extended and for holding such flag pole horizontally rearward when a pulling of a such tow rope on such long arm compresses such compression spring. Moreover, this invention provides such a warning flag system wherein such lever is essentially upwardly/rearwardly arcuate and concave, such short arm and such long arm being essentially situate at an angle of substantially less than 180 degrees.

DETAILED DESCRIPTION OF A PREFERRED EMBODIMENT AND THE BEST MODE OF PRACTICE

Figure 1:
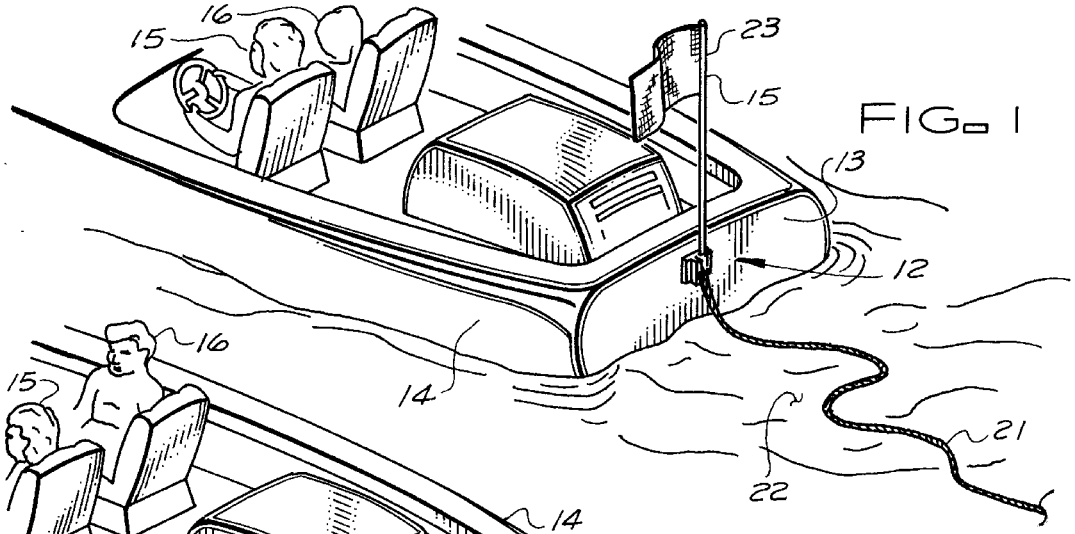
FIG. 1 is a perspective view of the water skier warning flag system of the present invention, on a ski boat, with the tow rope slack and the pole of the warning flag upwardly vertical.
Figure 2:
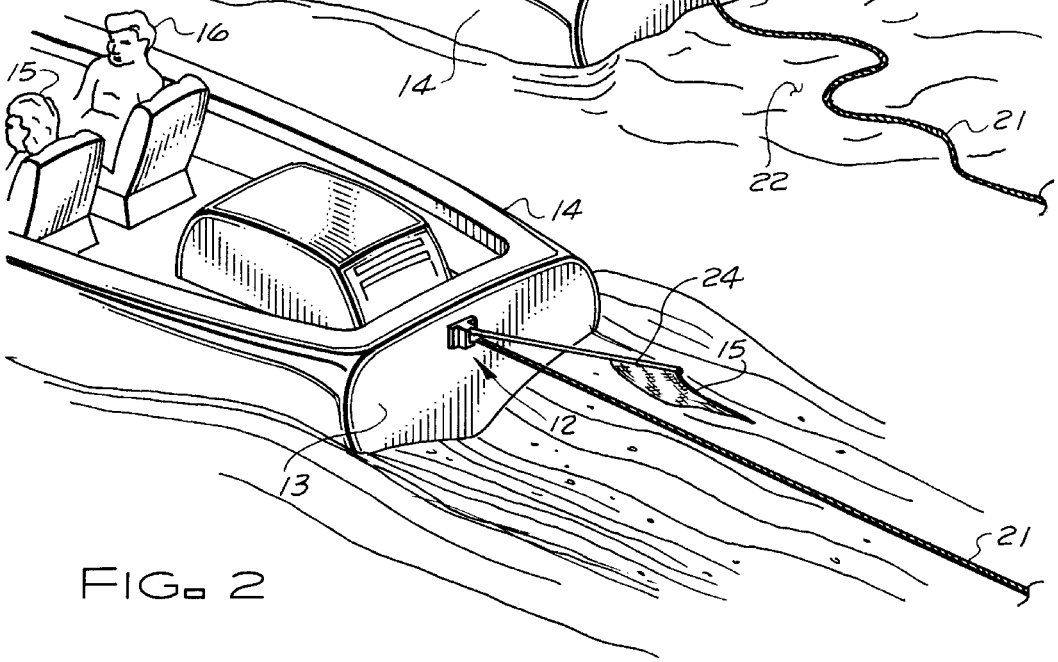
FIG. 2 is a perspective view of the instant warning flag system, on a ski boat, towing, with the pole of the warning flag substantially rearwardly horizontal.

Shown in perspective in FIGS. 1 and 2 is the preferred embodiment of the water skier warning flag system of the present invention for automatically raising a warning flag on a flag pole to the rear of a stern transom of a ski boat when a tow rope on such ski boat goes slack. A mechanical means for positionally controlling a flag pole or standard for a warning flag, embodied by warning flag system device 12, is shown mounted on the rear of the stern transom 13 of a common ski boat 14, and being used for the sport of water skiing. In FIG. 1, the ski boat 14 is shown stationary in the water, with the ski flag 15 raised upwardly indicating that a water skier is in the water, presumably either preparing to ski or ending a skiing session. In the ski boat 14, in addition to the driver 15, may be found a spotter 16 whose responsibility it is to provide communication between the skier (not shown) and driver 15, and also with other boats operating nearby. Communication with other boats in the immediate vicinity is with a ski flag which, when raised, indicates that a skier is in the water; and this indicates to use caution, reduce speed, or change course. The warning flag system device 12 automatically raises a ski flag 15 at any time the water skier is stationary in the water or has let go of the ski tow rope 21 of a moving ski boat 14. The automatic operation of the warning flag system device 12 is controlled by the tension of the ski tow rope 21. FIG. 1 shows the ski tow rope 21 slack in the water 22, not currently pulling a skier, as the ski boat 14 is at a stop, and the ski flag 15 is in the raised position 23 by the operation of the warning flag system device 12. In contrast, in FIG. 2 the ski boat 14 is in motion and the ski tow rope 21 is taut from the drag of the skier being towed, and the ski flag 15 is in the lowered position 24 as a result of the operation of the warning flag system device 12.

Figure 3:
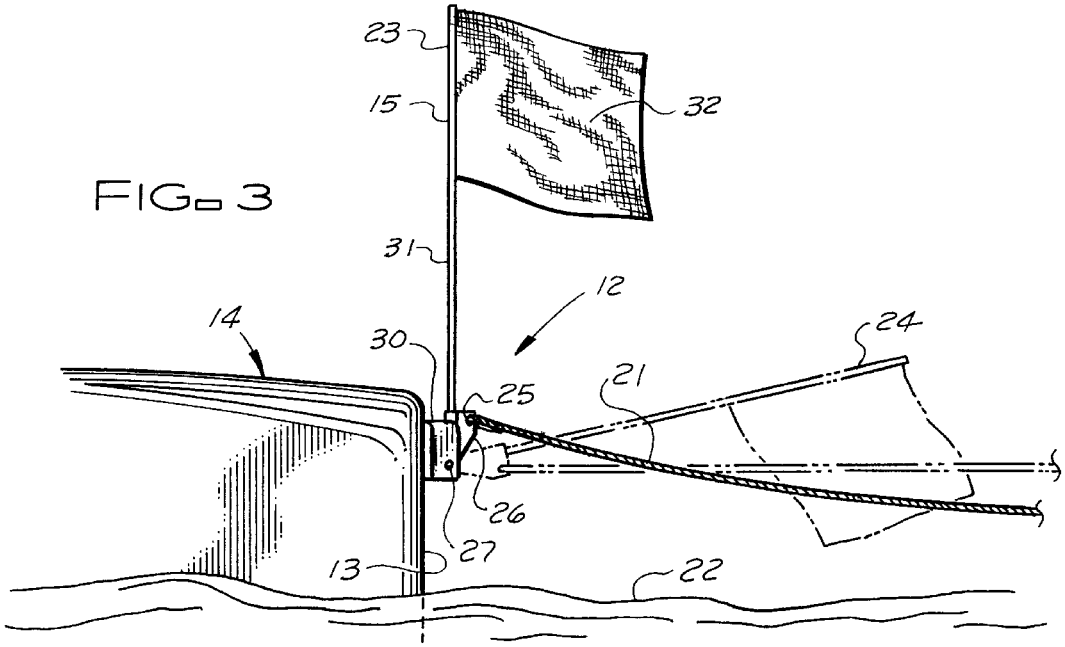
FIG. 3 is an elevation view of the present warning flag system, in operation, on the transom of a boat.

FIG. 3 shows the warning flag system of the present invention with the warning flag system device 12 of the present invention located on the transom 13 of a ski boat 14. The warning flag system device 12 incorporates an attachment hole 25 in lever arm 26, as a first means of such lever arm 26, for direct attachment of the ski tow rope 21. The warning flag system device 12 is securely connected on the rear of the transom 13 in the same general location as a conventional ski rope attachment device or eyelet, so that towing characteristics remain un-changed. The attachment hole 25 is located on the long lever arm 26 of lever 58 (not entirely shown), which is pivotally attached, at the pivot line 27, to the housing 30 of the warning flag system device 12. The housing 30 is securely bolted to the transom 13. Attached to the lever arm 26 (in a socket thereof, not shown, as a second means of such lever arm 26) is the standard or flag pole 31 of ski flag 15. The standard 31 of ski flag 15 would preferably be longer than a conventional hand held ski flag to compensate for the added height that a spotter's upraised arm adds to a conventional ski flag. Generally, standard 31 would be approximately 48" long. The warning flag or panel 32 of ski flag 15 remains the same as in a conventional hand held ski flag, being usually bright red in color, square in shape, and made of fabric or plastic sheet. The ski flag 15 and the lever arm 26, to which it is attached, are held in a normal upright or vertical position, which is the raised position 23, by spring pressure on the short lever arm (not shown here) of the lever 58 from the workings of the parts in housing 30. As both the ski tow rope 21 and the pole of ski flag 15 are attached to lever arm 26, unless sufficient pulling force is exerted by ski tow rope 21 to overcome this spring pressure, the ski flag 15 remains in the raised position 23. When ample pull is exerted upon the lever arm 26 by the ski tow rope 21, the lever arm 26 pivots downward, lowering the ski flag 15 to the lowered position 24 as shown by dotted lines. Appropriate raising and lowering action of the ski flag 15 is conditional upon correct spring pressure exerted by the workings of the parts in housing 30, to be further described. With the ski boat 14 at rest, the ski flag 15 remains upright. As the ski boat 14 begins to move forward, resistance from the ski tow rope 21 and its handle (not shown) being pulled through the water 22 is preferably not sufficient to pull the ski flag 15 downward. After the slack in the ski tow rope 21 is removed and the resistance of the water skier being pulled up out of the water (on ski or skis) is exerted upon the ski tow rope 21, the lever arm 26 with the ski flag 15 is pulled downward. While the water skier remains skiing, the ski flag 15 remains in the lowered position 24. If the water skier falls from or releases his grip on the ski tow rope 21, the ski flag 15 will raise. Correct spring pressure, geometry and operation of the warning flag system device 12 is important since the handle of the ski tow rope 21 while not being held by a skier, but being dragged through the water 22, continues to exert resistance. Additionally the ski flag 15 in a raised position 23 on a moving ski boat 14 offers resistance in the wind. These added sources of resistance are overcome by spring pressure preloading in well-known ways.

Figure 4:
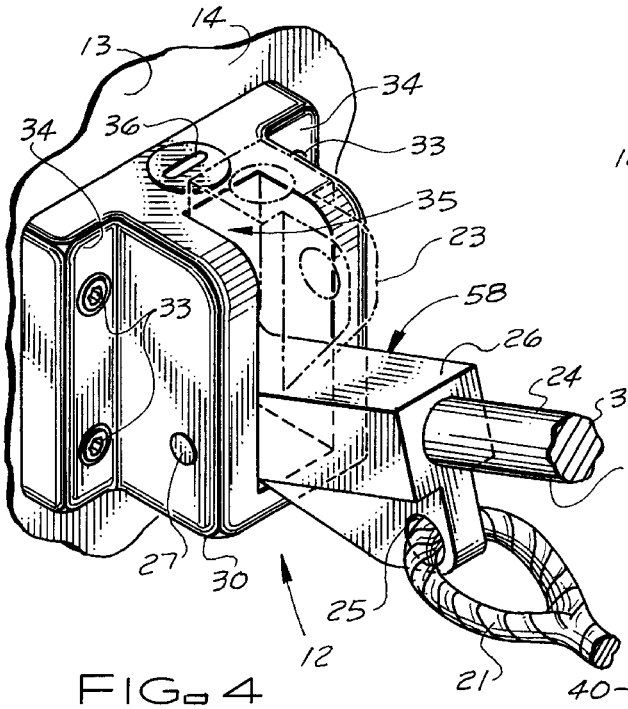
FIG. 4 is a perspective view of a preferred embodiment of the warning flag system device of the present invention.

Now referring to the construction of the warning flag system device 12, it is shown enlarged, in perspective, in FIG. 4. The housing means, embodied by housing 30, of the warning flag system device 12 is attached to the transom 13 of the ski boat 14 with housing connection means embodied by four bolts or screws 33 through the flanges 34 on both sides of the housing 30, as shown. The lever means of the present invention, embodied by lever 58, comprised of long lever arm 26 and short lever arm 66, is attached to the housing 30 at the lever pivot line 27. Lever arm 26 is illustrated in its lowered position 24 as it is when pulling a skier with a ski tow rope 21. Ski tow rope 21 is connected to lever arm 26 at attachment hole 25 by any desired means, such as tieing directly, hook, ring, eyelet, etc. Lever arm 26 additionally is the mounting for the standard 31 of the ski flag 15. When the lever arm 26 is in the raised position 23 as shown by dotted lines, it is located in well 35. Also shown is retainer 36, under which is located the compression spring means to be later described.

Figure 5:
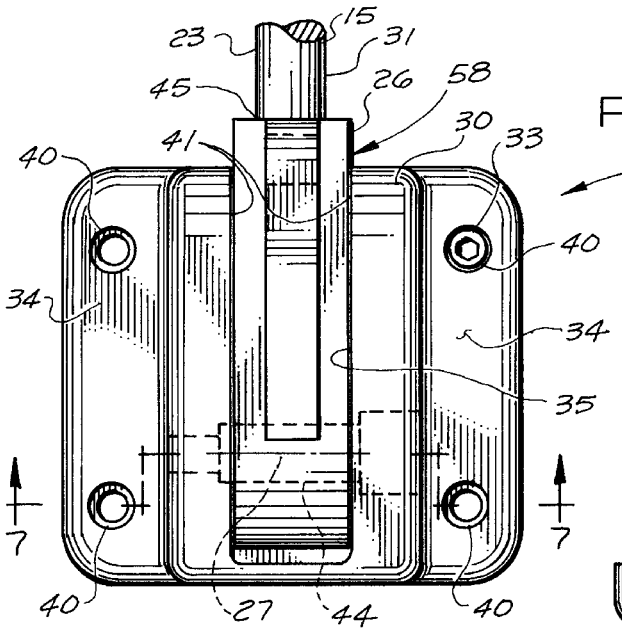
FIG. 5 is a rear elevation view of the warning flag system device.
Figure 6:
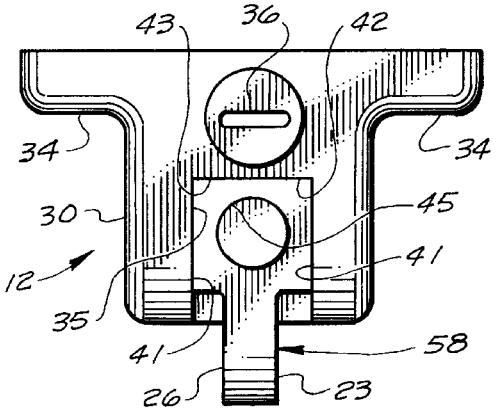
FIG. 6 is a top plan view of the warning flag system device.
Figure 9:
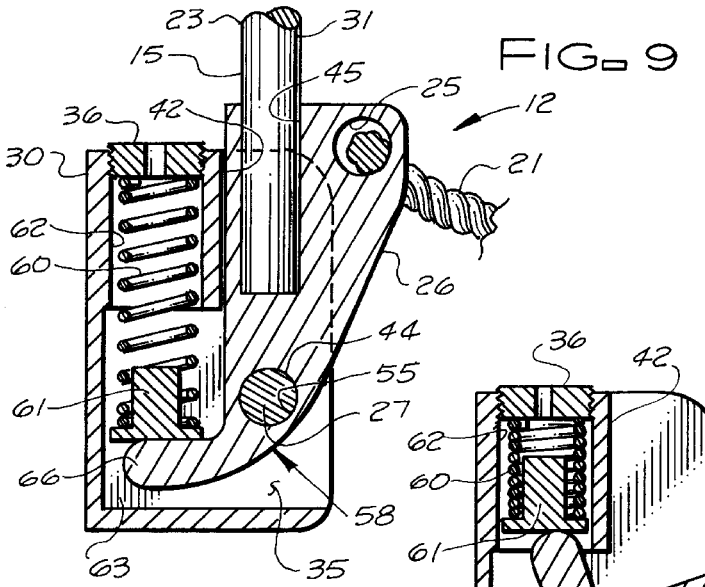
FIG. 9 is a cross-section side elevation view of the warning flag system, showing the flag pole in its vertical position.

The exterior of the warning flag system device 12 is additionally shown in rear elevation view in FIG. 5 and top plan view in FIG. 6. Features of the housing 30 include a flange 34 on each housing side having a total of four mounting holes 40 for screws or bolts 33, as shown. Well 35 houses the lever arm 26. Interior sides 41 of well 35 locate and guide lever 58, particularly lever arm 26. Additionally, the forward interior surface 42 of well 35 embodies the limiting stop 43 of the stop means for stopping travel of the long lever arm, lever arm 26, when the push of the compression spring means (to be described), by pushing on the short lever arm 66, pushes lever arm 26 into substantially vertical position, as shown in FIG. 9 and in dotted lines in FIG. 4. Lever arm 26 is attached to the housing 30 at pivot line 27 by a shaft means embodied by shoulder bolt 44, shown with hidden lines (and such bolt's seating holes 54 and 59, to be described). Such shaft means, as shown in the figures, lies in a substantially horizontal position and transverse to the ski boat; and such shaft means is nonrotatably connected to housing 30, as described and shown herein. At the end/top of lever arm 26 is a socket 45, as shown, embodying the means for connection to a flag pole, to accept the standard 31 of ski flag 15. Diameters of socket 45 and standard 31 are such that the standard 31 may be inserted snugly but also be removable when the ski boat 14 is not being used for skiing or when it is trailered. It is noted that the flag pole or standard 31, when held in socket 45, is preferably positioned (as shown) along a line perpendicular to and intersecting with pivot line 27.

Figure 7:
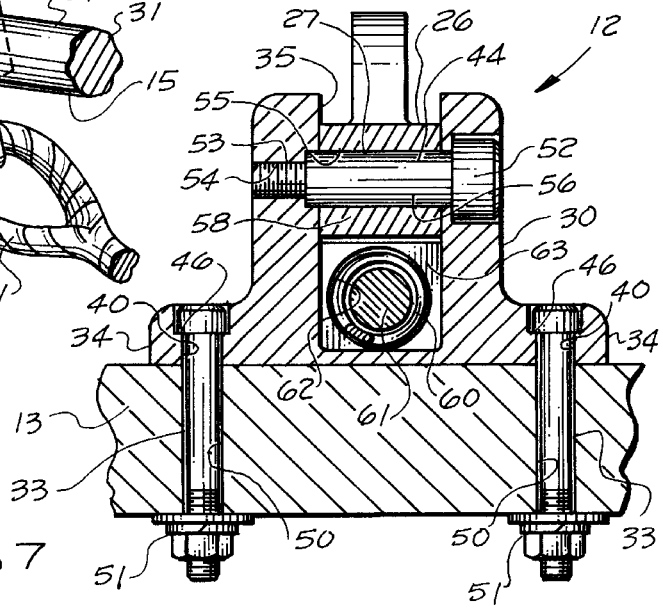
FIG. 7 is a cross-section view of the warning flag system device through section 7—7 of FIG. 5.

FIG. 7 is a cross-sectional view through the warning flag system device 12, looking upward at the offset section 7—7 of FIG. 5. The offset section shows the warning flag system device 12 mounted to the transom 13 of the ski boat 14 with screws 33 which are preferably hex socket head and inset into counterbores 46 of holes 40 of flange 34 of housing 30. Screws 33 are attached to the transom 13 through holes 50 and secured with suitable nuts and washers 51. Shown by cross-section is the lever means of this invention (embodied by lever 58 comprising long lever arm 26 and short lever arm 66), particularly the beginning and lower portion of lever arm 26 at pivot line 27 and around shoulder bolt 44. Shoulder bolt head 52 is inset into one side of housing 30 with its threaded end 53 tightened into threaded hole 54 at the opposite side of housing 30, as shown. Lever arm 26, shown positioned in well 35, contains transverse-hole means (along pivot line 27), embodied by hole 55, for pivoting on shaft or shank 56 of shoulder bolt 44. Also shown is the compression spring means of the present invention, embodied by spring 60 and spring seat 61, positioned in spring bore 62 underneath retainer 36 (not shown in this view). Additionally, within housing 30 is cavity 63 which is an extension rearwardly of, and located at the bottom of, well 35. Cavity 63 allows short lever arm 66 (not shown in this view) to ride against the spring seat 61. All components of the warning flag system device 12, with exception of the ski flag 15, are constructed of metal, such as steel and aluminum, and are suitable for use in a wet environment with platings or coatings as required.

Figure 8:
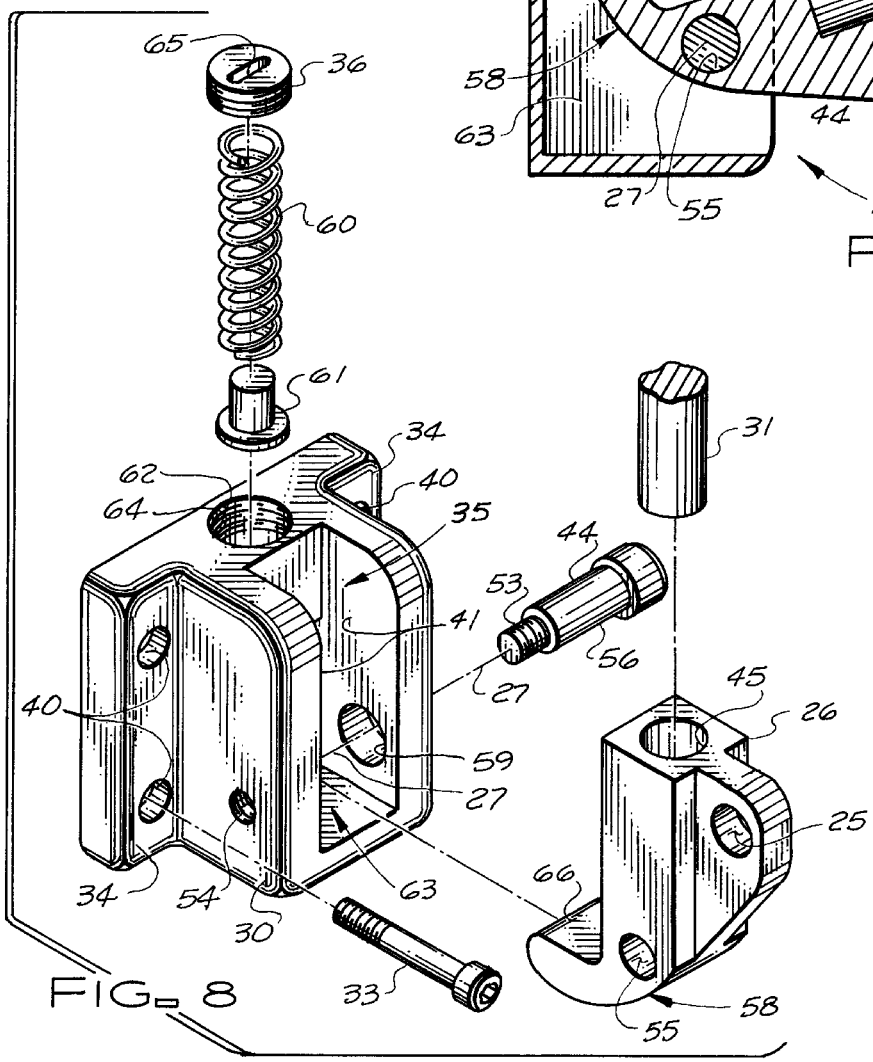
FIG. 8 is a perspective exploded view of the warning flag system device of the present invention.

Components of the warning flag system device 12 are shown in perspective in the exploded view of FIG. 8. Lever arm 26 incorporates socket 45 for insertion of standard 31 and attachment hole 25 for connection of the ski rope. Lever 58 attaches to housing 30 with shoulder bolt 44 through hole 55 at pivot line 27. Shoulder bolt 44 secures to housing 30 with its threaded end 53 tightened into threaded hole 54 and its shank 56 passing through hole 55 of lever 58. Housing 30 incorporates flanges 34 with holes 40 for mounting with screws 33 and well 35 with interior sides 41 for accepting lever arm 26. Not seen in this view is cavity 63 which is at the bottom rear of well 35. Contained within spring bore 62 is spring 60, a conventional compression coil spring, and spring seat 61, which are retained with a retainer 36 which is threaded and mates with threads 64 at the top opening of spring bore 62. Retainer 36 incorporates a through-slot 65, for installing with a screwdriver. Also, the through-slot 65 allows moisture to drain through the retainer 36. Included on lever 58 is short lever arm 66 which resides within cavity 63 and contacts the underside of spring seat 61.

Figure 10:
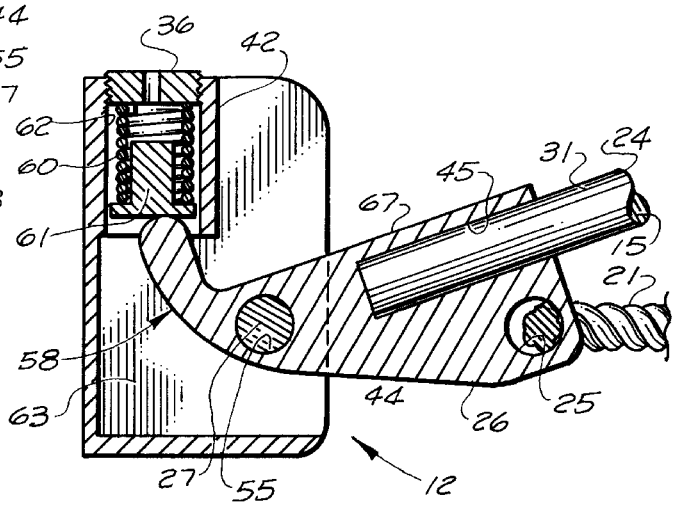
FIG. 10 is a cross-section side elevation view of the warning flag system, while towing, showing the flag pole in its substantially horizontal position.

FIGS. 9 and 10 show the warning flag system device 12 cut away in an elevation view cross section. Shown is the lever arm 26 with socket 45 for insertion of standard 31, attachment hole 25 for connection of the ski tow rope 21, and hole 55 at pivot line 27 for pivoting on shoulder bolt 44. Also shown clearly here is short lever arm 66 (of lever 58) which extends inward into cavity 63 of housing 30. Housing 30 incorporates spring bore 62 which houses spring 60 and spring seat 61. Spring 60 is retained within spring bore 62 with threaded retainer 36. As illustrated in FIG. 9, without tension on the ski tow rope 21, extension of spring 60 pushes spring seat 61 downward against short lever arm 66 of lever 58. Note that the end of short lever arm 66 is preferably a curved cam shape to best maintain contact with spring seat 61 during travel, in well known ways. Downward pressure against this cam tip of short lever arm 66 rotates lever 58 about the pivot line 27 until lever movement ceases when the inner flat surface 67 of lever arm 26 contacts the forward interior surface 42 of well 35 (which acts as a limiting stop 43). In this position the standard 31 of the ski flag 15 is hoisted vertically in its raised position 23. In contrast, FIG. 10 illustrates the warning flag system device 12 with the drag of a water skier applying tension to the ski tow rope 21. Lever arm 26 is pulled downward with the short lever arm 66 pushing upward against spring seat 61 and compressing spring 60. In this position, attachment hole 25 is rotated outwardly into substantial horizontal alignment with pivot line 27 and the ski tow rope 21, and the ski flag 15 is lowered to its lowered position 24. While in this operating configuration, if the drag of the water skier is removed from the ski tow rope 21, the spring 60, beginning in its fully compressed state, will rotate the lever arm 26 upward, providing automatic display of the ski flag 15.

It is noted that the lever 58 (as shown) is essentially arcuate (being concave upwardly and rearwardly), short lever arm 66 and long lever arm 26 being situate at an angle of substantially less than 180 degrees, as shown. This feature of the invention, along with its other features, permits the efficient vertical location of the compression spring 60, the efficient vertical stop of lever arm 26 permitting vertical positioning of the warning flag, the efficient small size of the device 12, the efficient location of the connection to the tow line 21, etc.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A water skier warning flag system for automatically raising a warning flag on a flag pole to the rear of a stern transom of a ski boat when a tow rope on the ski boat goes slack comprising, in combination:

mechanical means for positionally controlling the flag pole;

connection means for connecting said mechanical means to the stern transom of the ski boat;

said mechanical means comprising a lever structure having a short arm and a long arm and having transverse-hole means, through a pivot line of said lever structure, for holding a shaft means for rotatably holding said lever structure, housing means for housing said lever structure comprising a shaft means for rotatably holding said lever structure, and a compression spring means constructed and arranged to push against said short arm of said lever structure, first long arm means on said long arm for connecting with the tow rope, and second long arm means on said long arm for connecting with the flag pole.

2. A warning flag system according to claim 1 wherein said lever structure is essentially arcuate, said short arm and said long arm being situate at an angle of substantially less than 180 degrees.

3. A warning flag system according to claim 1 wherein said compression spring means is constructed and arranged to normally push said long arm into substantially vertical position.

4. A warning flag system according to claim 3 wherein said housing means further comprises stop means for stopping travel of said long arm when said push of said compression spring means pushes said long arm into said substantially vertical position.

5. A warning flag system according to claim 1 wherein said second long arm means is constructed and arranged to hold the flag pole longitudinally to said long arm.

6. A warning flag system according to claim 1 wherein said connection means is constructed and arranged to connect said mechanical means to the stern transom of the ski boat in such manner as to maintain said compression spring means in a substantially vertical position.

7. A warning flag system according to claim 1 wherein said connection means is constructed and arranged to connect said mechanical means to the stern transom of the ski boat in such manner as to maintain said shaft means in a substantially horizontal position and transverse to the ski boat.

8. A warning flag system according to claim 1 wherein said housing means is constructed and arranged in such manner as to maintain the flag pole, when held by said second long arm means, along a line perpendicular to and intersecting with said pivot line.

9. warning flag system according to claim 1 wherein said mechanical means is constructed and arranged in such manner as to compress said compression spring means when the tow rope is connected to said first long arm means and the tow rope is pulling substantially horizontally and rearwardly on said first long arm means.

10. A warning flag system according to claim 1 wherein said mechanical means is constructed and arranged in such manner as to maintain the flag pole, when held by said second long arm means, in a substantially horizontal position when a water skier is water skiing at a far end of the tow rope connected to said first long arm means and the tow rope is pulling substantially horizontally and rearwardly on said first long arm means.

11. A warning flag system according to claim 1 wherein said mechanical means is constructed and arranged in such manner as to maintain the flag pole, when held by said second long arm means, in a substantially vertical position after a water skier releases the tow rope connected to said first long arm means and the tow rope ceases pulling substantially horizontally and rearwardly on said first long arm means.

12. A warning flag system according to claim 1 wherein said shaft means is nonrotatably connected to said housing means.

13. A water skier warning flag system for automatically raising a warning flag on a flag pole to the rear of a stern transom of a ski boat when a tow rope on said ski boat goes slack comprising, in combination:

a ski boat having a stern transom;

a flag pole having a warning flag connected to a first end of said flag pole;

mechanical means for positionally controlling said flag pole, said mechanical means comprising a lever structure having a short arm and a long arm and having transverse-hole means, through a pivot line of said lever structure, for holding a shaft means for rotatably holding said lever structure, housing means for housing said lever structure comprising a shaft means for rotatably holding said lever structure, and a compression spring means constructed and arranged to push against said short arm of said lever structure, first long arm means on said long arm for connecting with a tow rope, and second long arm means on said long arm for connecting with a second end of said flag pole;

connection means for connecting said mechanical means to said stern transom of said ski boat; and a tow rope connected to said first long arm means.

14. A warning flag system according to claim 13 wherein said lever structure is essentially arcuate, said short arm and said long arm being situate at an angle of substantially less than 180 degrees.

15. A warning flag system according to claim 13 wherein said mechanical means is constructed and arranged in such manner as to compress said compression spring means when said tow rope is connected to said first long arm means and the tow rope is pulling substantially horizontally and rearwardly on said first long arm means.

16. A warning flag system according to claim 13 wherein said shaft means is nonrotatably connected to said housing means.

17. A warning flag system according to claim 16 wherein said mechanical means is constructed and arranged in such manner as to maintain said flag pole, when held by said second long arm means, in a substantially horizontal position when a water skier is water skiing at a far end of said tow rope connected to said first long arm means and said tow rope is pulling substantially horizontally and rearwardly on said first long arm means.

18. A warning flag system according to claim 17 wherein said mechanical means is constructed and arranged in such manner as to maintain said flag pole, when held by said second long arm means, in a substantially vertical position after the water skier releases said tow rope connected to said first long arm means and ceases pulling substantially horizontally and rearwardly on said first long arm means.

19. A water skier warning flag system for automatically raising a warning flag on a flag pole to the rear of a stern transom of a ski boat when a tow rope on the ski boat goes slack comprising, in combination:

a housing containing a vertical compression spring and means for connecting said housing to the rear of a stern transom;

a lever having a short arm and a long arm and rotatably connected rearward of said compression spring to said housing along a lever pivot line;

said housing being constructed and arranged in such manner that said compression spring pushes downwardly on said short arm;

said long arm being constructed and arranged for connecting with a tow rope; and said long arm also being constructed and arranged for holding said flag pole vertically upward when said compression spring is extended and for holding said flag pole horizontally rearward when a pulling of a tow rope on said long arm compresses said compression spring.

20. A warning flag system according to claim 19 wherein said lever is essentially upwardly/rearwardly arcuate and concave, said short arm and said long arm being essentially situate at an angle of substantially less than 180 degrees.

* * * * *